US010256561B2

(12) United States Patent
Humphrey

(10) Patent No.: US 10,256,561 B2
(45) Date of Patent: Apr. 9, 2019

(54) TERMINAL WITH RIBBED CONTACT SPRING

(71) Applicant: TE CONNECTIVITY CORPORATION, Berwyn, PA (US)

(72) Inventor: David Tracy Humphrey, Red Lion, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/479,644

(22) Filed: Apr. 5, 2017

(65) Prior Publication Data

US 2018/0294589 A1 Oct. 11, 2018

(51) Int. Cl.

| | |
|---|---|
| ***H01R 11/22*** | (2006.01) |
| ***H01R 13/14*** | (2006.01) |
| ***H01R 13/11*** | (2006.01) |
| ***H01R 13/187*** | (2006.01) |
| *H01R 4/18* | (2006.01) |

(52) U.S. Cl.

CPC ..... *H01R 13/14* (2013.01); *H01R 13/11* (2013.01); *H01R 13/113* (2013.01); *H01R 13/187* (2013.01); *H01R 4/185* (2013.01)

(58) Field of Classification Search

CPC ... H01R 9/0518; H01R 13/115; H01R 13/111; H01R 13/113; H01R 4/185

USPC ..... 439/585, 849–852, 865, 877

See application file for complete search history.

(56) References Cited

U.S. PATENT DOCUMENTS

| | | | | |
|---|---|---|---|---|
| 2,768,361 A | | 10/1956 | Aquillon et al. | |
| 2,774,951 A | | 12/1956 | Kinkaid et al. | |
| 2,787,774 A | | 4/1957 | Martines | |
| 2,888,662 A | | 5/1959 | Hammell | |
| 2,921,287 A | * | 1/1960 | Anderson | H01R 13/115 439/849 |
| 3,086,193 A | | 4/1963 | Berg | |
| 3,152,856 A | | 10/1964 | Batcheller | |
| 3,204,214 A | | 8/1965 | Eisert | |
| 3,228,207 A | | 1/1966 | Hartmann, Jr. et al. | |

(Continued)

FOREIGN PATENT DOCUMENTS

| | | |
|---|---|---|
| DE | 7807279 U1 | 8/1978 |
| EP | 0602681 A2 | 6/1994 |

OTHER PUBLICATIONS

U.S. Appl. No. 15/479,589, filed Apr. 5, 2017, David Tracy Humphrey et al, not published.

*Primary Examiner* — Thanh Tam T Le

(57) ABSTRACT

A terminal with ribbed contact springs for receipt of a mating terminal therein. The receptacle terminal has a contact portion which includes a bottom wall with contact sections extending from opposed sides of the bottom wall. Each of the contact sections have at least two resilient arms which extend from the bottom wall to a mating terminal engagement member. The at least two resilient arms have arcuate portions which extend from the bottom wall to the mating terminal engaging members. Each of the at least two resilient arms has a reduced contact spring rate, thereby allowing the contact normal force to be more accurately controlled with the same manufacturing tolerances. More controlled normal force allows for a minimum contact normal force to be reliably maintained while reducing the insertion force required during mating.

10 Claims, 3 Drawing Sheets

(56) References Cited

U.S. PATENT DOCUMENTS

| | | | | | |
|---|---|---|---|---|---|
| 3,320,574 | A | * | 5/1967 | Ulrich | H01R 4/188 439/745 |
| 3,546,663 | A | * | 12/1970 | Holmberg, Jr. | H01R 13/20 439/849 |
| 3,550,069 | A | * | 12/1970 | Teagno | H01R 13/115 439/849 |
| 3,729,701 | A | | 4/1973 | Smith | |
| 4,174,878 | A | * | 11/1979 | Debaigt | H01R 13/115 439/724 |
| 4,220,388 | A | * | 9/1980 | Dechelette | H01R 13/115 439/268 |
| 4,415,221 | A | * | 11/1983 | Inoue | H01R 13/20 439/268 |
| 4,445,745 | A | | 5/1984 | Cartesse | |
| 4,448,468 | A | | 5/1984 | Coldren | |
| 4,534,613 | A | * | 8/1985 | Esser | H01R 13/115 439/834 |
| 5,295,874 | A | | 3/1994 | Yoneda et al. | |
| 5,395,270 | A | | 3/1995 | Jinno et al. | |
| 5,733,154 | A | * | 3/1998 | Libregts | H01R 4/182 439/850 |
| 6,039,615 | A | * | 3/2000 | Suzuki | H01R 13/113 439/849 |
| 6,068,526 | A | | 5/2000 | Nottrott et al. | |
| 6,293,831 | B1 | | 9/2001 | Yamatani | |
| 6,997,746 | B2 | * | 2/2006 | Taylor | H01R 13/115 439/585 |
| 7,166,002 | B2 | * | 1/2007 | Fukuda | H01R 13/187 439/849 |
| 7,255,614 | B1 | | 8/2007 | Irish et al. | |
| 7,845,993 | B2 | | 12/2010 | Falchetti | |

* cited by examiner

TERMINAL WITH RIBBED CONTACT SPRING

FIELD OF THE INVENTION

The present invention is directed to a terminal with a ribbed contact spring. In particular, the invention is directed to a socket type terminal in which the curved cantilevered spring beams have a reduced contact spring rate.

BACKGROUND OF THE INVENTION

Socket terminals which are adapted for quick make and break connections with a mating terminal are known. Terminals of this kind are often made from thin sheet metal and are used to make an electrical connection to a male or space terminal which is inserted and frictionally held in the socket terminal. A socket terminal of this type is shown in U.S. Pat. No. 3,086,193.

It is often necessary to disconnect and reconnect such terminals a number of times for testing purposes prior to final inspection and shipment of the product on which such terminals are used. It is also required that the connection made with such terminals be maintained under conditions of vibration and possible strain in subsequent service. Traditionally, these terminals have a high insertion mating force which is not desirable, causing ergonomic problems with insertion when a mating connector is inserted into the socket terminal.

It would, therefore, be beneficial to provide a socket type terminal which has ribbed contact springs which have a reduced contact spring rate, thereby allowing the contact normal force to be more accurately controlled with the same manufacturing tolerances. More controlled normal force allows for a minimum contact normal force to be reliably maintained while reducing the insertion force required during mating. The invention is also directed to ribbed contact springs which have a longer aspect-ratio to provide more deflection with the same normal force, thereby providing a stable electrical connection while allowing for a lower insertion force of the mating terminal into the socket terminal.

SUMMARY OF THE INVENTION

An object is to provide a terminal with a ribbed contact spring.

An object is to provide a socket type terminal in which the curved cantilevered spring beams have a reduced contact spring rate.

An object is to provide a socket type terminal which has ribbed contact springs which have a reduced contact spring rate, thereby allowing the contact normal force to be more accurately controlled with the same manufacturing tolerances. More controlled normal force allows for a minimum contact normal force to be reliably maintained while reducing the insertion force required during mating.

An object is to provide a ribbed contact springs which has a longer aspect-ratio to provide more deflection with the same normal force, thereby providing a stable electrical connection while allowing for a lower insertion force of the mating terminal into the socket terminal.

An object is to provide a socket type terminal which provides a stable electrical connection while allowing for a lower insertion force of the mating terminal into the socket terminal.

An embodiment is directed to a terminal with ribbed contact springs for receipt of a mating terminal therein. The receptacle terminal has a contact portion which includes a bottom wall with contact sections extending from opposed sides of the bottom wall. Each of the contact sections have at least two resilient arms which extend from the bottom wall to a mating terminal engagement member. The at least two resilient arms are spaced apart. The at least two resilient arms have arcuate portions which extend from the bottom wall to the mating terminal engaging members. Each of the at least two resilient arms generates a contact force when a mating terminal is inserted into the terminal.

An embodiment is directed to a terminal with ribbed contact springs for receipt of a mating terminal therein. The receptacle terminal has a contact portion which includes a bottom wall with contact sections extending from opposed sides of the bottom wall. A spring arm is provided on the bottom wall. Each of the contact sections has at least two resilient arms which extend from the bottom wall to a mating terminal engagement member. The at least two resilient arms have arcuate portions which extend from the bottom wall to the mating terminal engaging members. Mating terminal engaging members extend from the arcuate portions toward the bottom wall in a direction which is essentially perpendicular to the plane of the bottom wall. The mating terminal engagement surfaces are positioned at a top of a mating slot. The arcuate portions provide the resiliency to allow the mating terminal engaging member to move relative to the bottom wall as the mating terminal is inserted into the mating slot. Each of the at least two resilient arms generating a contact force when a mating terminal is inserted into the terminal.

An embodiment is directed to a terminal with ribbed contact springs for receipt of a mating terminal therein. The receptacle terminal has a contact portion which includes a bottom wall with contact sections which extend from opposed sides of the bottom wall. A spring arm is provided on the bottom wall. A raised portion of the bottom wall provides increased stiffness to the bottom wall and the contact portion to achieve the desired normal force for the insertion of a mating terminal. Each of the contact sections has at least two resilient arms which extend from the bottom wall to a mating terminal engagement member. The at least two resilient arms have arcuate portions which extend from the bottom wall to the mating terminal engaging members, the at least two resilient arms being wider at base to better distribute forces. Mating terminal engaging members extend from the arcuate portions toward the bottom wall in a direction which is essentially perpendicular to the plane of the bottom wall. The mating terminal engagement surfaces are positioned at a top of a mating slot. The arcuate portions provide the resiliency to allow the mating terminal engaging member to move relative to the bottom wall as the mating terminal is inserted into the mating slot. Each of the at least two resilient arms generating a contact force when a mating terminal is inserted into the terminal.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
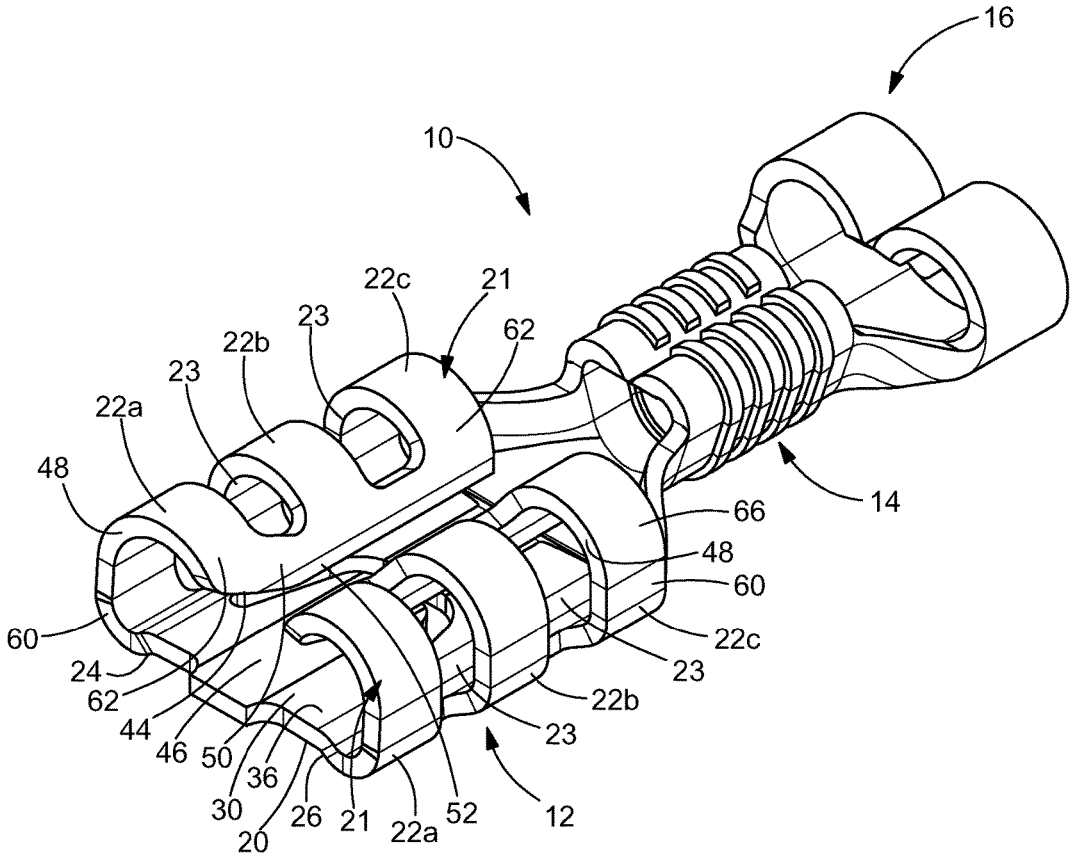
FIG. 1 is perspective view of an illustrative embodiment of the terminal according to the present invention.
Figure 2:
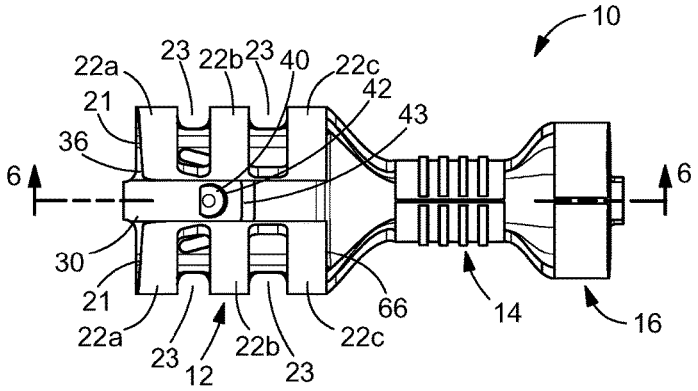
FIG. 2 is a top view of the terminal of FIG. 1.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

As best shown in FIGS. 1 through 4, a receptacle, socket or female terminal 10 includes a contact portion 12, a wire barrel 14 behind the contact portion 12 and an insulation barrel 16 behind the wire barrel 14. The wire barrel 14 is configured for crimped connection with an end of a conductive core of an insulated wire. The insulation barrel 16 is configured for crimped connection with an end of the insulation coating or jacket of the wire. Although a wire barrel 14 and an insulation barrel 16 are shown, the contact portion 12 can be used with other types of termination members without departing from the scope of the invention. In the illustrative embodiment shown, the terminal 10 is stamped and formed from a metal plate having a good electrical conductivity.

Figure 5:
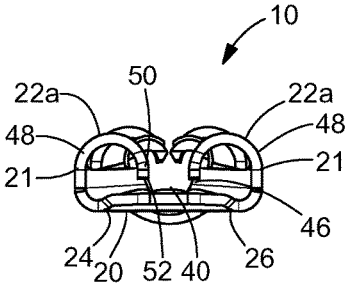
FIG. 5 is a front view of the terminal of FIG. 1.
Figure 3:
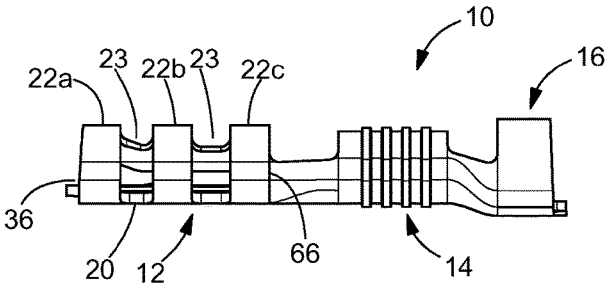
FIG. 3 is a side view of the terminal of FIG. 1.
Figure 6:
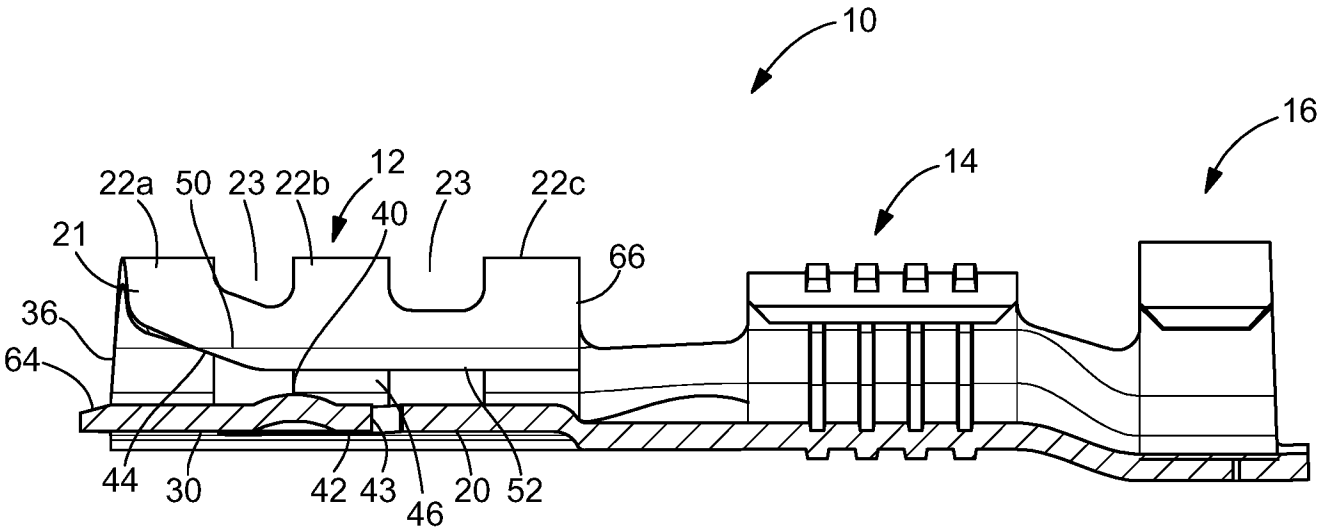
FIG. 6 is a cross-sectional view of the terminal of FIG. 2, taken along line 6-6.

Referring to FIGS. 1, 5 and 6, the contact portion 12 includes a bottom wall 20 and resilient arms 22 which extend from either side 24, 26 of the bottom wall 20 to form ribbed spring contact sections 21. As best shown in FIG. 6, the bottom wall 20 has a raised portion 30 with a detent, dimple or lance-through raised shape 40 provided thereon. The raised portion 30 provides increased stiffness to the bottom surface 20 and the contact portion 12 to achieve the desired normal force for the insertion of a mating contact (not shown). In the illustrative embodiment shown, the raised portion 30 is a rectangular platform which provides sufficient stiffness to the terminal 10 to properly control the geometry of the terminal 10 as the mating terminal is inserted therein.

The detent 40 extends from the bottom wall 20 to create a raised portion or arm extending from the inner surface of the bottom wall 20 toward the resilient arms 22. The detent 40 engages the mating terminal as the mating terminal is inserted into the terminal 10, as will be more fully described below.

A further description of a particular configuration of the bottom wall 20 is provided in co-pending U.S. patent application Ser. No. 15/479,589, filed on the same date as this Application, which is herein incorporated by reference in its entirety.

In the illustrative embodiment shown, each ribbed spring contact section 21 has three resilient arms 22 which extend from either side 24, 26 of the bottom wall 20. The first resilient arm 22*a* is positioned proximate a mating end 36 of the contact portion 12. Openings or spaces 23 extend between and separate the resilient arms 22. In the embodiment shown, the openings or spaces 23 are formed by removing material from a blank prior to forming the terminal. The material removed can be reused in the manufacture of additional terminals. Other methods for forming the openings 23 may be used without departing from the scope of the invention.

The resilient arms 22*a*, 22*b*, 22*c* have arcuate or curled portions 48 which extend from the bottom wall 20 to a mating terminal engaging member 50, as best shown in FIGS. 1 and 6. In one illustrative embodiment, one or all of the resilient arms 22*a*, 22*b*, 22*c* may have a tapered or trapezoidal configuration, whereby the width, of the respective arm at the root or base 60, which connects to bottom wall 20, is greater than the width of portion 62 of the respective arm proximate the mating terminal engaging member 50. In the embodiment shown, resilient arms 22*a* have a tapered or trapezoidal configuration. In other embodiments, the base 60 and portion 62 may have similar widths, as shown in resilient arms 22*b*, 22*c* of the illustrated embodiment. The configuration of each respective spring arm allows the stiffness and spring rate of each respective resilient arm 22*a*, 22*b*, 22*c* to be controlled. A wider root or base 60 allows for a higher spring rate and for a more even distribution of forces from the respective resilient arms 22*a*, 22*b*, 22*c* to the bottom wall 20. Conversely, the more narrow the respective resilient arms 22*a*, 22*b*, 22*c*, the lower the spring rate of the arm and the lower the effective spring rate of ribbed spring contact section 21. Consequently, the respective resilient arms 22*a*, 22*b*, 22*c* may each be configured to generate a different contact force.

In various illustrative embodiments, resilient arms 22*a* may have a tapered lead-in surface 64 (FIGS. 1 and 6) to facilitate the insertion at the mating contact into the slot 46 of the contact portion 12. The tapered surface 64 is configured to prevent the stubbing of the mating contact on the edge of the resilient arms 22*a*.

In various illustrative embodiments, resilient arms 22*c* have a back surface or edge 66 which extends in a direction which is essentially perpendicular to the longitudinal axis of the terminal 10. This provides a reference surface which can be used when positioning the terminal 10 in a housing or when mating the mating terminal to the terminal 10.

The mating terminal engagement members 50 extend from the resilient arms 22 and, in the illustrative embodiment shown, are asymmetrical, having lead-in surfaces 44 positioned proximate the mating end 36. The lead-in surfaces 44 are provided to help guide the mating terminal into the mating slot 46 of the contact portion 12 and to reduce the insertion force required to insert the mating terminal into the slot 46. A mating terminal engagement surface 52 is provided on each mating terminal engaging member 50. In the embodiment shown, the mating terminal engaging member 50 extends from the arcuate portions 48 toward the bottom wall in a direction which is essentially perpendicular to the plane of the bottom wall 20, positioning the mating terminal engagement surface 52 at the top of the mating slot 46. The configuration of the arcuate portions 48 provide the resiliency needed to allow the mating terminal engaging member 50 to move relative to the bottom wall 20 as the mating terminal is inserted into the slot 46.

Figure 4:
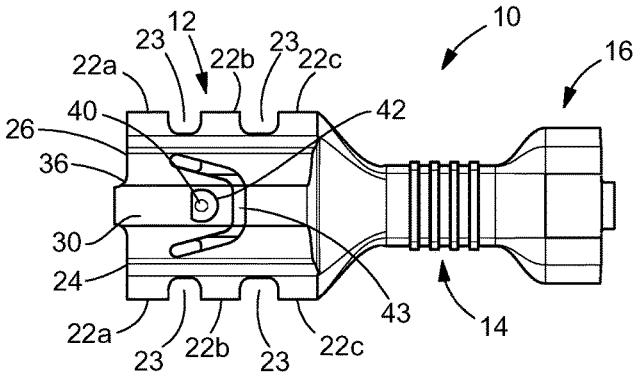
FIG. 4 is a bottom view of the terminal of FIG. 1.

The detent 40 may be stamped, coined or formed from the bottom wall 20 or a spring arm 42. In the illustrative embodiment shown, the spring arm 42 is stamped and formed from the raised portion 30. Spring arm 42 may have a U-shaped configuration, as shown in FIG. 4, or may have numerous other configurations, such as, but not limited, to rectangular or round. The spring arm 42 is formed to allow a free end 43 thereof to move or be resiliently deformed relative to the bottom wall 20, allowing the spring arm 42 to move toward and away from the mating terminal engaging member 50.

In the illustrative embodiment shown, the spring arm 42 has the detent 40 provided thereon. The detent 40 extends from the spring arm 42 to create a raised portion which extends from the inner surface of the spring arm 42 toward the mating terminal engaging member 50. The detent 40 is provided proximate to, but spaced from, the free end 43 of the spring arm 42.

The configuration of the contact portion 12 allows the contact portion 12 to compensate for any slight misalignment of the mating terminal or any slight warpage or imperfections associated with the mating terminal.

A terminal according to the teaching of the invention has a lower spring rate than know terminals. By controlling the space and size of the contact arms 22 and the openings 23, the normal forces and insertion forces of the terminal can be controlled, while allowing for a proper electrical connection between the terminals 10 and the mating terminals. For example, the insertion force of a terminal made according to the present invention may be reduced by half or more in comparison to a terminal without individual contact arms 22 separated by openings 23.

In addition, as the spring rate is reduced, the resilient arms 22 of the spring contact section 21 allows for a greater spring deflection before taking a permanent set. This allows the terminal to be used with mating terminals which have some variance in manufacturing tolerances. In other words, because the resilient arms 22 have the ability to deflect a greater distance without taking a permanent set, the thickness of the mating terminal does not have be precisely controlled.

In a fully inserted position, the free end 43 of the spring arm 42, the detent 40 and the mating terminal engagement surfaces 52 are all provided in electrical and mechanical contact with the mating terminal. The multiple areas of contact allow the receptacle contact 10 to be used in applications in which higher current levels, such as, but not limited to, 15 to 20 or more amps. The configuration of the free end 43 of the spring arm 42, the detent 40 and mating terminal engagement surfaces 52 provide for higher hertzian stresses, thereby eliminating or minimizing the fretting corrosion between the mating terminal 10, thereby providing a stable and reliable electrical connection between the mating terminal and the terminal 10.

The cooperation of the free end 43 of the spring arm 42, the detent 40 and the mating terminal engagement surfaces 52 are spaced laterally relative to each other, allowing the connection between the mating terminal and the receptacle terminal 10 to be stable in all environments, thereby insuring that the mating terminal will remain properly positioned in the receptacle terminal 10 as vibration occurs.

The free end 43 of the spring arm 42, the detent 40 and the mating terminal engagement surfaces 52 are laterally offset from each other, the receptacle terminal 10 provides multiple contact areas even if the mating terminal is bent. In addition, the multiple contact areas resist twisting or misalignment of the mating terminal.

In one embodiment, the resilient arms 22 and are configured such that the contact areas of the mating terminal engagement surfaces 52 generate an equal and opposite force to resist the force generated by the free end 43 of the spring arm 42 and the detent 40. In addition, the resilient arms 22 and are configured such that the contact areas of the free end 43 of the spring arm 42 and the detent 40 generate an equal and opposite force to resist the force generated by the mating terminal engagement surfaces 52. However, the configuration of the resilient arms 22 may be varied to allow the contact areas to have varied forces associated therewith. In particular, the positioning of the free end 43 of the spring arm 42 and the detent 40 can alter the force applied by each contact area.

As the detent 40 and the free end 43 of the spring arm 42 are transversely offset relative to the path of insertion of the mating terminal, the plating wear on the mating terminal at any particular area is minimized, as the wear is distributed over different areas.

The configuration of the bottom wall 20 and the resilient arms 22 and the use of multiple contact areas allows for a lower normal force during mating and unmating of the mating terminal from the receptacle contact 10. This allows the mating terminal and receptacle contact 10 to be more durable over numerous cycles, as there is less plating wear due to the lower mating or normal forces. The number of contact areas also allows the receptacle contact 10 to be used at higher current levels, as the number of contact areas allows the extreme heat associated with the high current levels to be dispersed, thereby preventing welding of the contact asperities.

The terminal of the present invention has ribbed contact springs which have a reduced contact spring rate, thereby allowing the contact normal force to be more accurately controlled with the same manufacturing tolerances. More controlled normal force allows for a minimum contact normal force to be reliably maintained while reducing the insertion force required during mating. The ribbed contact springs have a longer aspect-ratio to provide more deflection with the same normal force, thereby providing a stable electrical connection while allowing for a lower insertion force of the mating terminal into the socket terminal.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A terminal with ribbed contact springs for receipt of a mating terminal therein, the terminal having a contact portion comprising:

a bottom wall with contact sections extending from opposed sides of the bottom wall, the bottom wall having a raised rectangular platform which extends the length of the contact portion to provide increased stiffness to the bottom wall, across the length of the bottom wall, and to the contact portion, a spring arm formed in the raised rectangular platform, a free end of the spring arm configured to move relative to the raised rectangular platform of the bottom wall;

each of the contact sections having at least two resilient arms which extend from the bottom wall to a mating terminal engagement member, the at least two resilient arms of the contact sections being spaced apart by an opening which extend from the bottom wall to the mating terminal engagement member;

the mating terminal engagement members extend from the at least two resilient arms of the contact sections across the opening toward the bottom wall in a direction which is essentially perpendicular to the plane of the bottom wall, a mating terminal engagement surface is provided on each mating terminal engaging member, the mating terminal engagement surface is provided at a top of a mating slot;

the at least two resilient arms having bases extending from the bottom wall and ends proximate the mating terminal engagement members, the bases of the at least two resilient arms being spaced apart by the opening, one of the at least two resilient arms of the contact sections has a tapered configuration with a width at the base, in a direction parallel to a longitudinal axis of the contact portion of the terminal, being greater than a width at the end proximate the mating terminal engaging members, in a direction parallel to the longitudinal axis of the contact portion of the terminal, to distribute forces associated with the at least two resilient arms to the bottom wall;

the at least two resilient arms of the contact sections having arcuate portions which extend from the base to the end proximate the mating terminal engaging members;

each of the at least two resilient arms generating a contact force when the mating terminal is inserted into the terminal;

whereby the raised rectangular platform of the bottom wall provides increased stiffness to the bottom wall and the contact portion to achieve the desired normal force for the insertion of the mating terminal.

2. The terminal as recited in claim 1, wherein a detent is stamped, coined or formed from the spring arm of the bottom wall, the detent extends from the spring arm to create a raised area on the inner surface of the spring arm.

3. The terminal as recited in claim 1, wherein the at least two resilient arms have different sizes.

4. The terminal as recited in claim 1, wherein the at least two resilient arms have the same base sizes.

5. The terminal as recited in claim 1, wherein the at least two resilient arms are three resilient arms which extend from either side of the bottom wall.

6. The terminal as recited in claim 1, wherein the mating terminal engaging members extend from the arcuate portions toward the bottom wall in a direction which is essentially perpendicular to a plane of the bottom wall, the mating terminal engagement members are positioned at a top of a mating slot, the arcuate portions provide the resiliency to allow the mating terminal engaging members to move relative to the bottom wall as the mating terminal is inserted into the mating slot.

7. A terminal with ribbed contact springs for receipt of a mating terminal therein, the receptacle terminal having a contact portion comprising:

a bottom wall with contact sections extending from opposed sides of the bottom wall, the bottom wall having a raised rectangular platform which extends the length of the contact portion, the raised rectangular platform is configured to provide increased stiffness to the bottom wall and the contact portion, a spring arm provided on the bottom wall formed in the raised rectangular platform, a free end of the spring arm configured to move relative to the raised rectangular platform of the bottom wall;

each of the contact sections having three resilient arms, the resilient arms of the contact sections extend from the bottom wall to mating terminal engagement members;

the resilient arms having arcuate portions which extend from the bottom wall to the mating terminal engaging members, the three resilient arms of each of the contact sections are spaced apart by openings, the openings of each of the contact sections extend from the bottom wall to the mating terminal engaging member of each of the contact sections, each of the arcuate portions of the resilient arms having a width, in a direction parallel to a longitudinal axis of the terminal, at a base portion which extends from the bottom wall, the width at the base portion is greater than a width, in a direction parallel to the longitudinal axis of the terminal, at an end of the arcuate portion proximate the mating terminal engaging members;

the mating terminal engaging members extending from the arcuate portions across the openings and toward the bottom wall in a direction which is essentially perpendicular to a plane of the bottom wall, the mating terminal engagement members positioned at a top of a mating slot, the arcuate portions providing the resiliency to allow the mating terminal engaging members to move relative to the bottom wall as the mating terminal is inserted into the mating slot;

wherein each of the resilient arms generating a contact force when the mating terminal is inserted into the terminal;

wherein the raised rectangular platform of the bottom wall provides increased stiffness to the bottom wall and the contact portion to achieve the desired normal force for the insertion of the mating terminal;

wherein the stiffness and spring rate of the resilient arms is controlled by the configuration of the raised rectangular platform of the bottom wall and the configuration of the resilient arms.

8. The terminal as recited in claim 7, wherein an embossment is stamped, coined or formed from the spring arm of the bottom wall, the embossment extends from the spring arm to create a raised area on the inner surface of the spring arm.

9. The terminal as recited in claim 7, wherein the base portions of each of the resilient arms have different sizes.

10. The terminal as recited in claim 7, wherein the base portions of at least two resilient arms of the resilient arms have the same size.

* * * * *